US007657048B2

(12) United States Patent
van Halteren et al.

(10) Patent No.: US 7,657,048 B2
(45) Date of Patent: Feb. 2, 2010

(54) ACOUSTICAL RECEIVER HOUSING FOR HEARING AIDS

(75) Inventors: Aart Zeger van Halteren, Hobrede (NL); Paul Christiaan van Hal, Hoom (NL)

(73) Assignee: Sonion Nederland B.V., Amsterdam (NL)

( * ) Notice: Subject to any disclaimer, the term of this patent is extended or adjusted under 35 U.S.C. 154(b) by 635 days.

(21) Appl. No.: 11/634,586

(22) Filed: Dec. 6, 2006

(65) Prior Publication Data

US 2007/0127744 A1 Jun. 7, 2007

Related U.S. Application Data

(63) Continuation of application No. 09/992,253, filed on Nov. 16, 2001, now Pat. No. 7,181,035.

(60) Provisional application No. 60/252,756, filed on Nov. 22, 2000.

(51) Int. Cl.
*H04R 25/00* (2006.01)

(52) U.S. Cl. ..... 381/322; 381/368

(58) Field of Classification Search ..... 381/179, 381/322, 324, 327, 328, 380.354, 345, 189, 381/392, 368

See application file for complete search history.

(56) References Cited

U.S. PATENT DOCUMENTS

| | | | |
|---|---|---|---|
| 3,048,668 | A | 8/1962 | Weiss |
| 3,257,516 | A | 6/1966 | Knowles |
| 3,588,383 | A | 6/1971 | Carlson et al. |
| 3,671,684 | A | 6/1972 | Tibbetts et al. |
| 4,081,782 | A | 3/1978 | Hildreth et al. |
| 4,272,654 | A | 6/1981 | Carlson |
| 4,430,520 | A | 2/1984 | Tibbetts et al. |
| 4,440,982 | A | 4/1984 | Keanders et al. |
| 4,447,677 | A | 5/1984 | Miyahra et al. |
| 4,520,236 | A | 5/1985 | Gauthier |
| 4,620,605 | A | 11/1986 | Gore et al. |
| 4,634,815 | A | 1/1987 | Marquis |
| 4,729,451 | A | 3/1988 | Brander et al. |
| 4,763,752 | A | 8/1988 | Haertl et al. |
| 4,854,415 | A | 8/1989 | Goschke |
| RE33,718 | E | 10/1991 | Carlson et al. |

(Continued)

FOREIGN PATENT DOCUMENTS

| | | |
|---|---|---|
| DE | 23 46 531 | 4/1975 |

(Continued)

OTHER PUBLICATIONS

European Search Report for Application No. EP 01 20 4474 dated Jun. 13, 2006 (3 pages).

*Primary Examiner*—Tuan D Nguyen
(74) *Attorney, Agent, or Firm*—Nixon Peabody LLP

(57) ABSTRACT

An acoustic receiver comprises means for converting an input audio signal into an acoustic signal. The receiver has a housing having a plurality of sides that surround the converting means. One of the sides include an output port for broadcasting the acoustic signal. A jacket fits around the housing and has sections for engaging the sides. The sections are generally flat. The jacket may also form a gap with a corresponding side surface of the housing. A printed circuit board can be located within the gap. The printed circuit board including electronics for processing said input audio signal.

21 Claims, 8 Drawing Sheets

U.S. PATENT DOCUMENTS

| | | | |
|---|---|---|---|
| 5,193,116 | A | 3/1993 | Mostardo |
| 5,204,917 | A | 4/1993 | Arndt et al. |
| 5,220,612 | A | 6/1993 | Tibbetts et al. |
| 5,335,286 | A | 8/1994 | Carlson |
| 5,404,408 | A | 4/1995 | Strohmaier et al. |
| 5,610,989 | A | 3/1997 | Salvage et al. |
| 5,692,060 | A | 11/1997 | Wickstrom |
| 5,740,261 | A | 4/1998 | Loeppert et al. |
| 5,809,151 | A | 9/1998 | Husung |
| 6,078,677 | A | 6/2000 | Dolleman et al. |
| 6,169,810 | B1 | 1/2001 | van Halteren et al. |
| 6,456,720 | B1 | 9/2002 | Brimhall et al. |
| RE38,351 | E | 12/2003 | Iseberg et al. |
| 6,751,326 | B2 | 6/2004 | Nepomuceno |
| 2001/0036289 | A1 | 11/2001 | Nepomuceno |
| 2002/0061113 | A1 | 5/2002 | van Halteren et al. |
| 2002/0146141 | A1 | 10/2002 | Geschiere et al. |

FOREIGN PATENT DOCUMENTS

| | | |
|---|---|---|
| DE | 199 54 880 | 1/2001 |
| EP | 0 337 195 | 3/1989 |
| EP | 0 349 835 | 6/1989 |
| EP | 0 416 155 | 9/1989 |
| EP | 0 354 698 | 2/1990 |
| EP | 0 589 308 | 9/1993 |
| GB | 2 305 067 | 3/1997 |
| WO | WO 93/25053 | 12/1993 |
| WO | WO 95/07014 | 3/1995 |
| WO | WO 97/34443 | 9/1997 |
| WO | WO 99/43193 | 9/1999 |
| WO | WO 00/42815 | 7/2000 |
| WO | WO 00/79832 | 12/2000 |
| WO | WO 01/43498 | 6/2001 |
| WO | WO 01/69974 | 9/2001 |

ACOUSTICAL RECEIVER HOUSING FOR HEARING AIDS

RELATED APPLICATION

This application is a continuation of prior application Ser. No. 09/992,253, filed Nov. 16, 2001, now U.S. Pat. No. 7,181,035 which claimed the benefit of priority of U.S. Provisional Patent Application No. 60/252,756, filed Nov. 22, 2000.

FIELD OF THE INVENTION

The invention relates to receivers used in telecommunications equipment and hearing aids. In particular, the present invention relates to a housing having improved sturdiness and electromagnetic shielding while still maintaining small dimensions.

BACKGROUND OF THE INVENTION

A conventional hearing aid or listening device can include both a microphone and a telecoil for receiving inputs. The microphone picks up acoustic sound waves and converts the acoustic sound waves to an audio signal. That signal is then processed (e.g., amplified) and sent to the receiver (or "speaker") of the hearing aid or listening device. The speaker then converts the processed signal to an acoustic signal that is broadcast toward the eardrum.

On the other hand, the telecoil picks up electromagnetic signals. The telecoil produces a voltage over its terminals when placed within an electromagnetic field, which is created by an alternating current of an audio signal moving through a wire. When the telecoil is placed near the wire carrying the current of the audio signal, an equivalent audio signal is induced in the telecoil. The signal in the telecoil is then processed (e.g. amplified) and sent to the receiver (or "speaker") of the hearing aid for conversion to an acoustic signal.

Similarly, a typical telecommunication system consists of a combination of a receiver and a microphone in one housing. The signal from the microphone to the receiver is amplified before the receiver broadcasts the acoustic signal toward the eardrum.

In a typical balanced armature receiver, the housing is made of a soft magnetic material, such as a nickel-iron alloy. The housing serves several functions. First, the housing provides some level of sturdiness. Second, the housing also provides a structure for supporting the electrical connections. Third, the housing provides both magnetic and electrical shielding. Lastly, the housing may provide acoustical and vibrational isolation to the rest of the hearing aid.

In either a telecommunication system or a hearing aid, the gain introduced between the microphone and the receiver may result in feedback problems. The vibration or acoustical radiation of the receiver creates an undesirable feedback signal that is received by the microphone. Furthermore, in a hearing aid with a telecoil, a magnetic feedback signal may create feedback problems.

In both hearing aids and telecommunication devices, it is important for the receiver to be configured to withstand the forces associated with handling without damaging the housing. These forces can arise through the assembly of the receiver within a hearing aid, such as when a receiver is grasped with tweezers while it is being positioned or when force is placed on the housing when electrical connections are being made. Disfiguring the housing can easily occur because the housing material is thin and has a low hardness. One common type of damage is a simple dent that can occur in the housing. Dents can affect not only the electronics within the housing, but they can affect the performance of the acoustical chambers within the receiver. Because the housing of a receiver is typically made of a case and a cover that are made by a drawing technique, dents near the interface of the case and cover can also lead to acoustic leaks at the interface. Because of the minimal thickness of the material in the housing and a minimal size of the receiver, magnetic and acoustical isolation are limited.

Thus, a need exists for a receiver having small dimensions, but which has enhanced structural integrity and electromagnetic shielding.

SUMMARY OF THE INVENTION

It is an object of this invention to provide extra material outside the receiver, namely a jacket, to improve all functions of the housing mentioned previously.

An acoustic receiver comprises means for converting an input audio signal into an acoustic signal. The receiver has a housing having a plurality of sides that surround the converting means. In one embodiment, the converting means includes a balanced armature. One of the sides include an output port for broadcasting the acoustic signal. A jacket fits around the housing and has sections for engaging the sides. The sections are generally flat. The jacket may also form a gap with a corresponding side surface of the housing. A printed circuit board can be located within the gap. The printed circuit board includes electronics for processing the input audio signal.

By adding the jacket at strategic places on the housing, a very stiff package can be made. Further, by choosing the right material other factors can also be optimized. For example, a soft magnetic material can assist in electromagnetic shielding. If magnetic shielding is not an issue, it might be better to use stainless steel, which has a higher hardness and can give some stiffness and acoustical isolation in a smaller package. For telecom applications a plastic housing can be used. Such a receiver housing may having mating portions allowing for it to be snapped into a plastic housing of the overall assembly.

In yet another embodiment the receiver may include a dampening material or epoxy, which gives dampening of acoustical radiation and vibrations. Other materials can also improve vibrational or acoustical dampening. In another embodiment the jacket is made of relatively thick flexible print material such as Kapton.

BRIEF DESCRIPTION OF THE DRAWINGS

The foregoing and other advantages of the invention will become apparent upon reading the following detailed description and upon reference to the drawings.

Figure 1A:
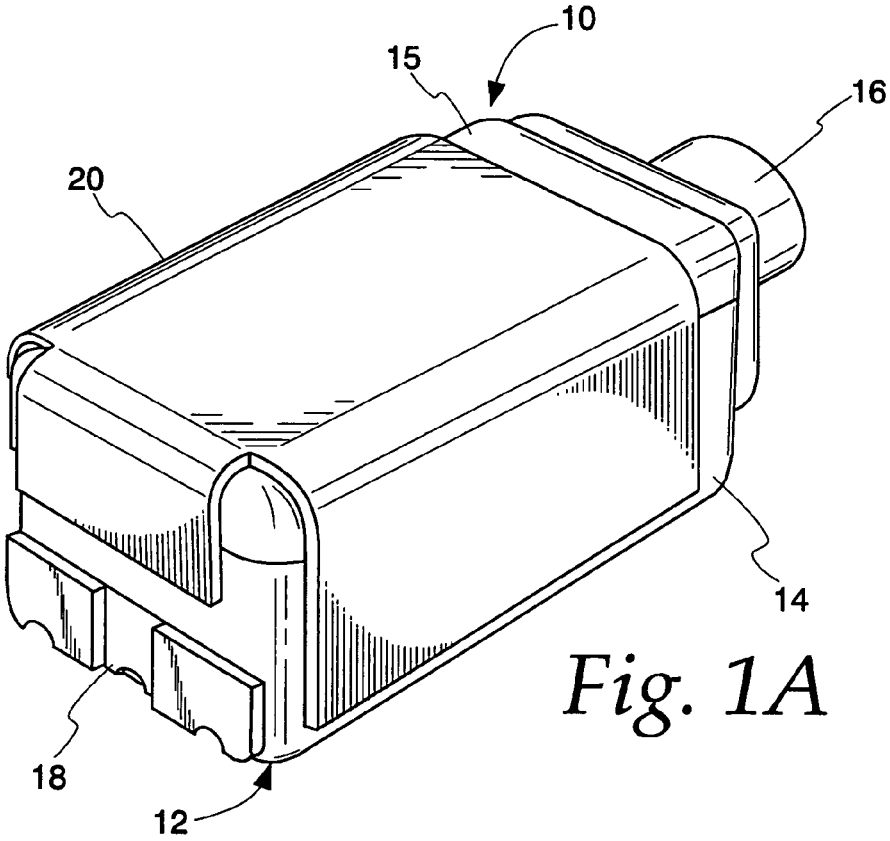
FIGS. 1A and 1B illustrate one embodiment of the present invention including a jacket attached to the housing of a receiver.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 1B:
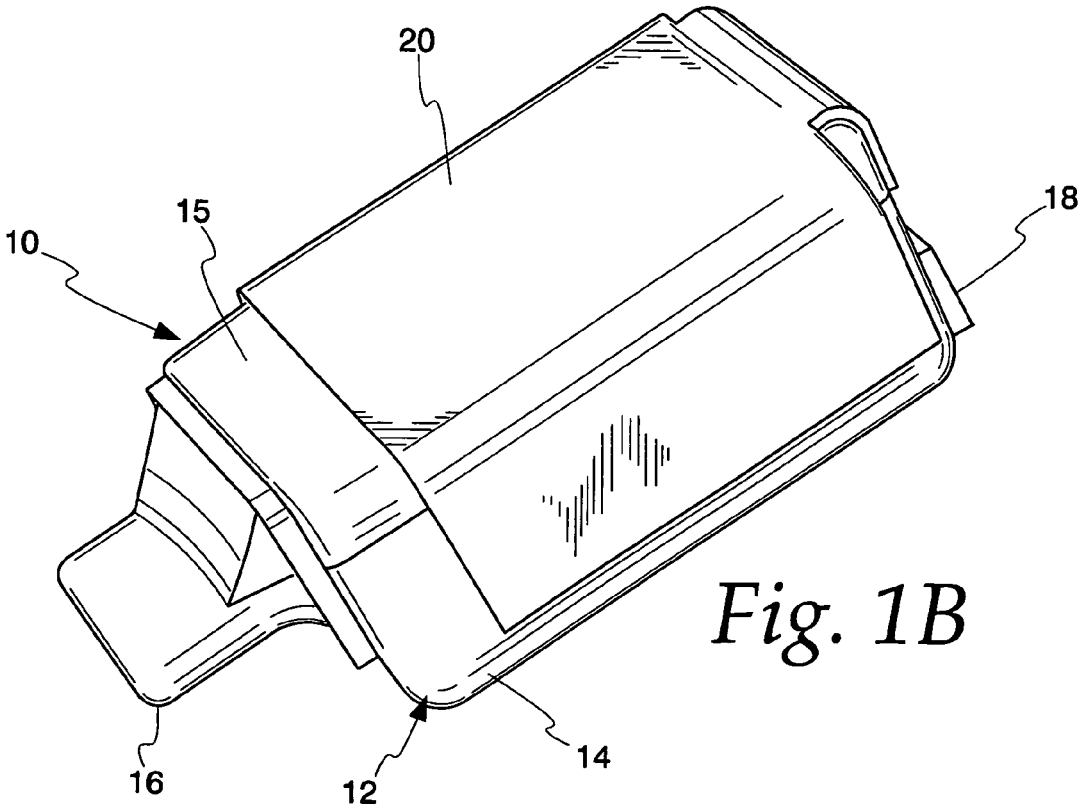

FIGS. 1A and 1B illustrate a first embodiment of the present invention. An acoustic receiver 10 includes various working components that convert an input audio signal into an acoustic signal. These working components typically include several electromagnetic components that move a drive element coupled to a diaphragm for creating the acoustic signal. In the disclosed embodiment, the receiver 10 is a balanced armature receiver. An example of a receiver is disclosed in commonly assigned U.S. Pat. No. 6,075,870, titled "Electroacoustic Transducer With Improved Shock Resistance," which is incorporated herein by reference in its entirety.

A housing 12 surrounds the working components and includes a case 14 and a cover 15 above the case 14. The housing 12 has six sides, each of which is generally rectangular. Of course, the housing 12 may take the form of various shapes (e.g., cylindrical, D-shaped, or trapezoid-shaped) with a different number of sides. One end surface of the housing 12 includes an output port 16 for transmitting the acoustical signal toward the listener's eardrum. Another end surface of the housing 12 includes an electrical connector assembly 18 that typically has two or three contacts on a printed circuit board. The electrical connector assembly 18 receives an input audio signal that is converted by the internal working components to an output acoustic signal that is broadcast from the output port 16.

A jacket 20 has sections that cover three of the major side surfaces of the housing 12, and the end surface where the electrical connector assembly 18 is located. Each of the sections is generally flat and closely interfits with the corresponding one of the side surfaces of the housing 12. The jacket 20 can be made of a variety of materials that serve the purpose of increasing the structural integrity of the housing 12 and may also provide some level of electromagnetic shielding. For example, the jacket 20 may be made of a soft magnetic material such as a nickel-iron alloy (usually the preferred material for the housing 12), stainless steel, or a polymeric material such as Kapton. In the disclosed embodiment, the jacket 20 is stainless steel having a thickness of between approximately 0.05 mm and 0.2 mm, and is preconfigured to the disclosed shape. If a polymer is used, the polymer would typically have a thickness of 0.2 mm to 0.3 mm. After the receiver 12 has been fully assembled and tested, the jacket 20 is press-fit onto the housing 12. It may also be attached to the housing 12 via an adhesive.

By adding material to the outside of the housing 12, the receiver 10 is much more stiff and less prone to structural damage. Further, the additional mass from the jacket 20 reduces the vibration of the receiver 10, which decreases the vibrational feedback to the microphone to which the receiver 10 is coupled. If enhanced electromagnetic shielding is desired, the jacket 20 can be made of a material that provides this effect, such as a nickel-iron alloy.

Figure 2A:
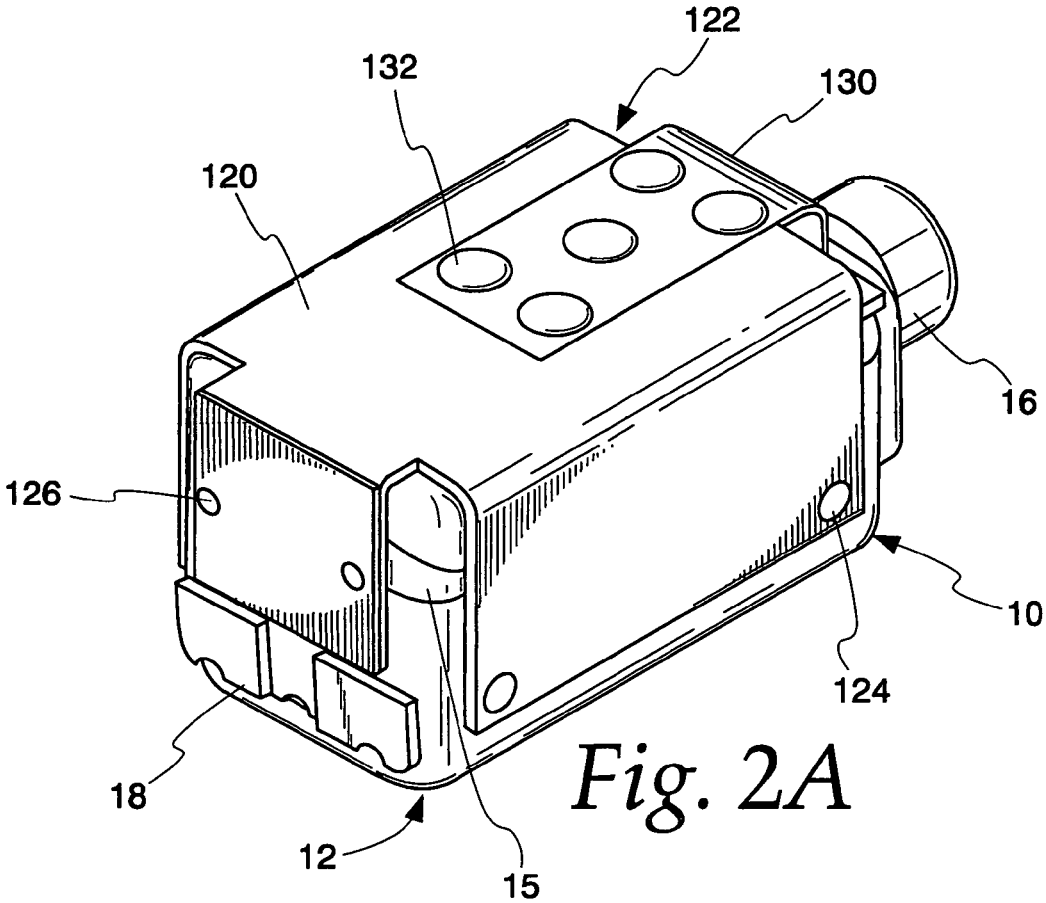
FIGS. 2A and 2B illustrate another embodiment of the present invention including a jacket and a flexible printed circuit board having electronics for processing the audio signal that is sent to the receiver.
Figure 2B:
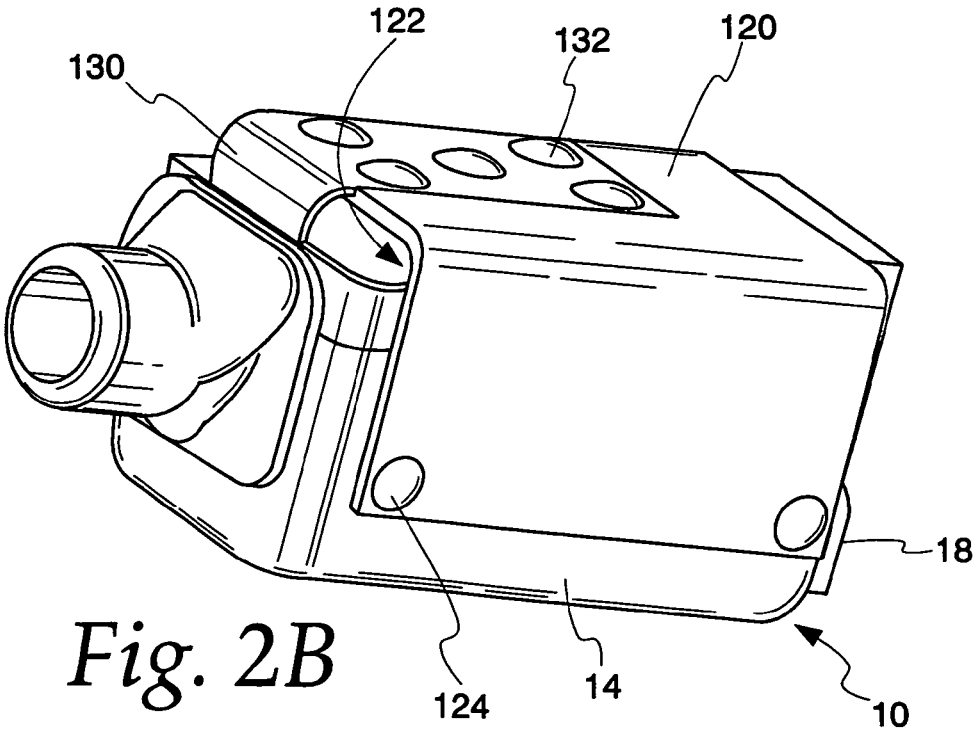

FIGS. 2A and 2B disclose another embodiment of the present invention. Here, the receiver 10 includes a jacket 120 that is positioned to define a gap 122 between the housing 12 and the jacket 120. Unlike the previous embodiment, the jacket 120 is spot-welded to the housing 12. One set of welds 124 is located on the case 14 and another set of welds 126 is located on the cover 15. Accordingly, the jacket 120 may serve the additional purpose of holding the cover 15 on the case 14. In some receivers, the base of the output port 16, which straddles the case 14 and the cover 15, serves this purpose and in those situations, the output port 16 can be relieved of this function if the jacket 120 is used for this purpose.

A flexible printed circuit board 130 ("flex-PCB") is located within the gap 122. The flex-PCB 130 contains various signal processing components, which are located under the jacket 120. For example, the flex-PCB 130 may contain an amplifier that receives the audio signal from a microphone that amplifies it before sending the signal into the receiver 10. The flex-PCB 130 also includes a plurality of electrical contacts 132 for receiving the audio signal directly from the microphone or indirectly through other signal processing circuitry.

In FIGS. 2A and 2B, the gap 122 defined by the jacket 120 can be thought of as convenient location for the electronic circuitry in the system located between the microphone and the receiver 10. Accordingly, the flex-PCB 130 must be connected via leads to the electrical connector assembly 18 of the receiver to transmit the input audio signal. Those leads can be attached to the electrical contacts 132, or other electrical contacts located underneath the jacket 120. This embodiment is advantageous since it allows the receiver 10 to be fully tested and calibrated (if needed) and later assembled into the jacket 120 which, along with the flex-PCB 130, has other signal processing electronics.

Figure 3A:
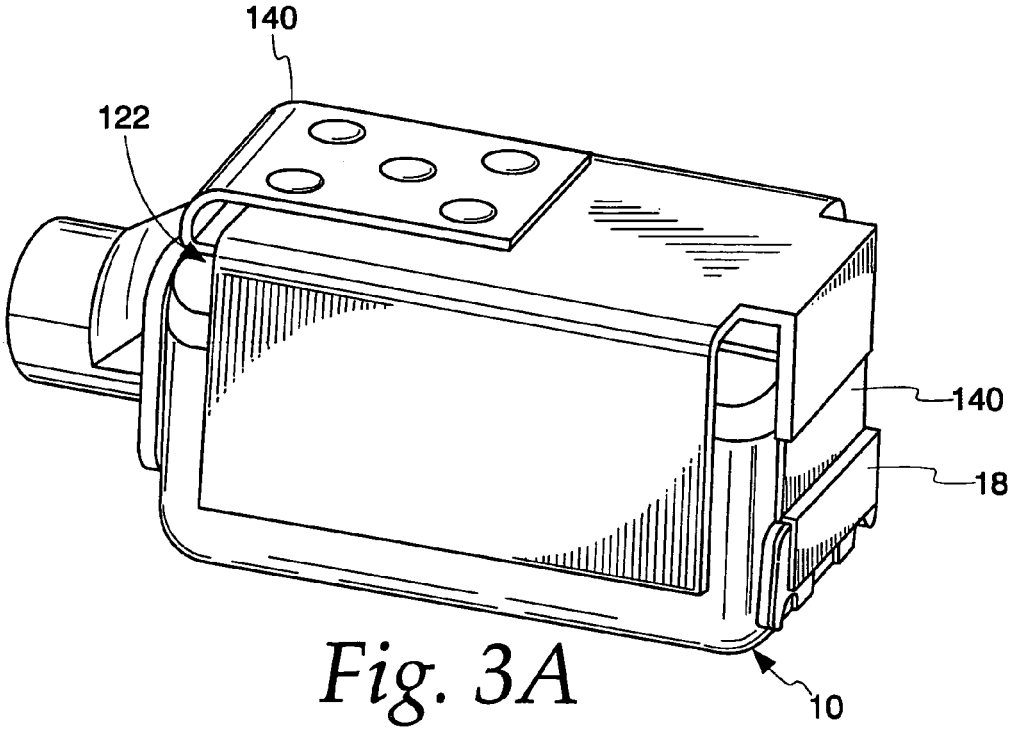
FIGS. 3A and 3B illustrate a variation of FIGS. 2A and 2B.
Figure 3B:
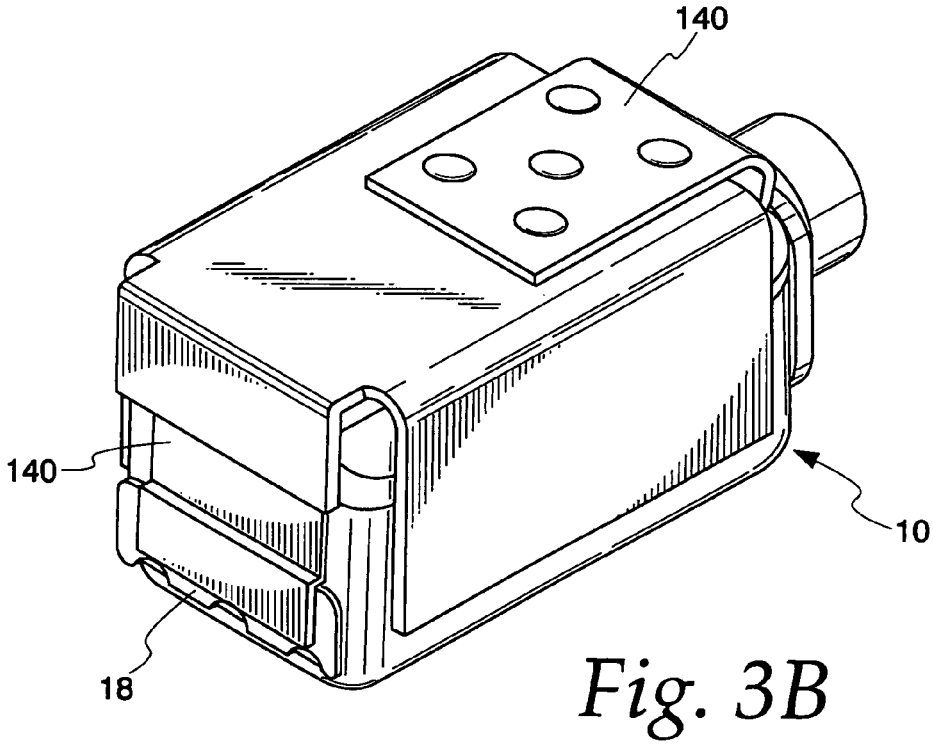

FIGS. 3A and 3B illustrate a variation of the embodiment of FIGS. 2A and 2B in that the gap 122 defined by the jacket 120 receives an extended flex-PCB 140. The extended flex-PCB 140 is directly connected to the electrical connector assembly 18, thereby eliminating the need for lead wires connecting the extended flex-PCB 140 to the electrical connector assembly 18. One other notable change from FIGS. 2A and 2B is that the jacket 120 is preconfigured to tightly fit over the extended flex-PCB 140 and the receiver 10 and may be held there with adhesive.

Figure 4A:
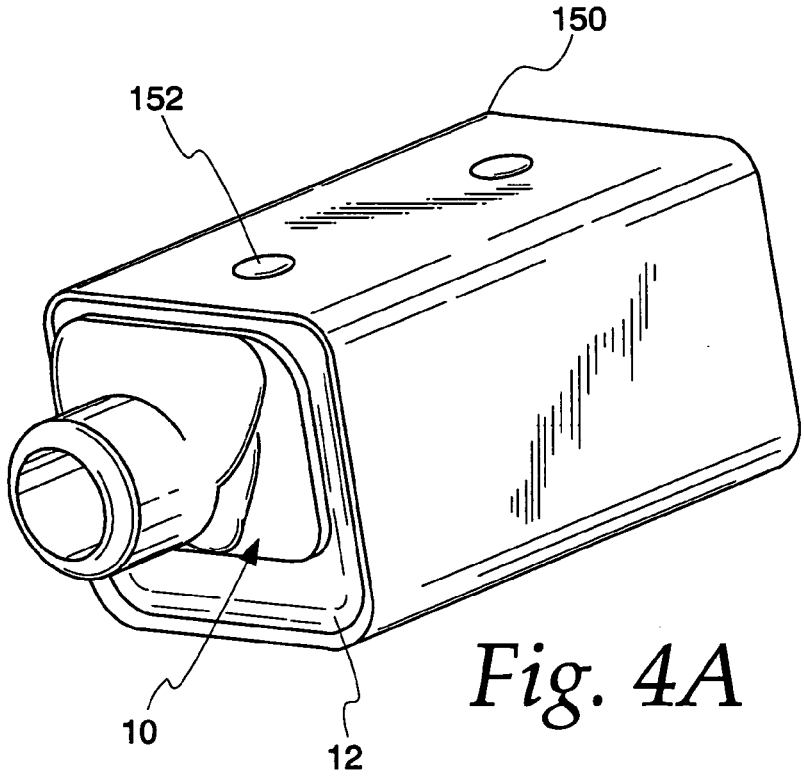
FIGS. 4A and 4B illustrate yet another embodiment of the present invention where the jacket is a tube casing that surrounds the receiver.
Figure 4B:
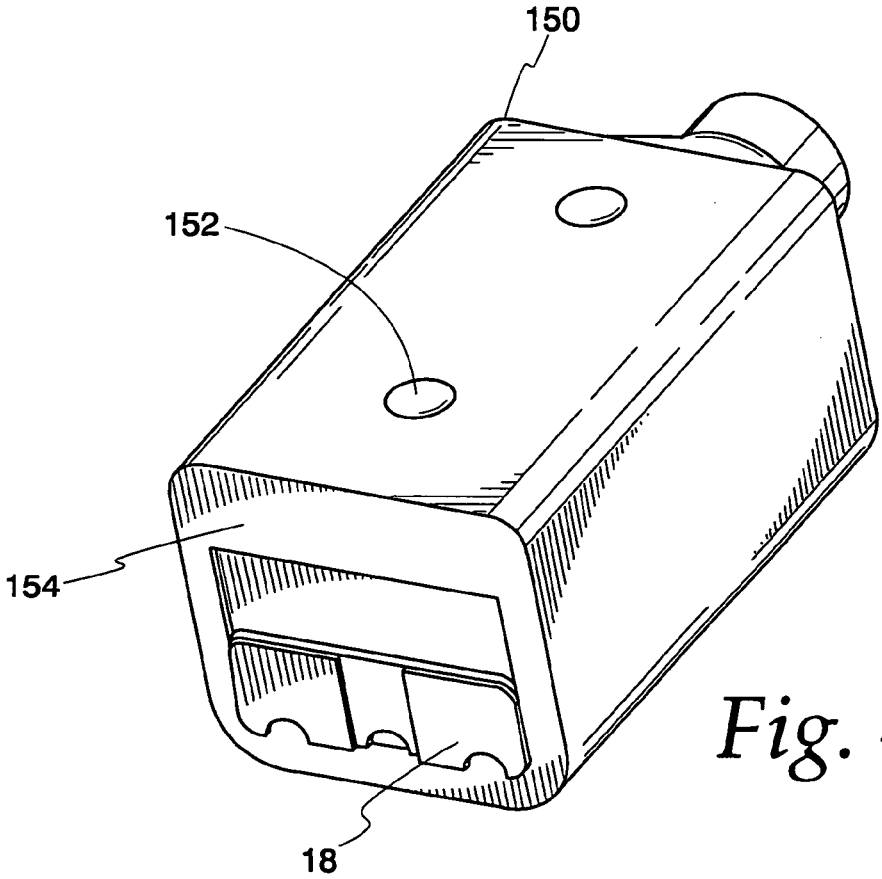

FIGS. 4A and 4B illustrate a jacket 150 in the form of a tubular casing. The jacket 150 includes four sides for closely interfitting with the housing 12 of the receiver 10. The four sides are contacting the housing 12 and are held on the housing 12 via a plurality of spot welds 152. The rear side 154 of the jacket 150 is partially opened to provide access to the electrical connector assembly 18 of the receiver 10. The jacket 150 lacks a gap to provide a region into which a flex-PCB can be placed. However, the jacket 150 could be configured in such a manner.

Figure 5A:
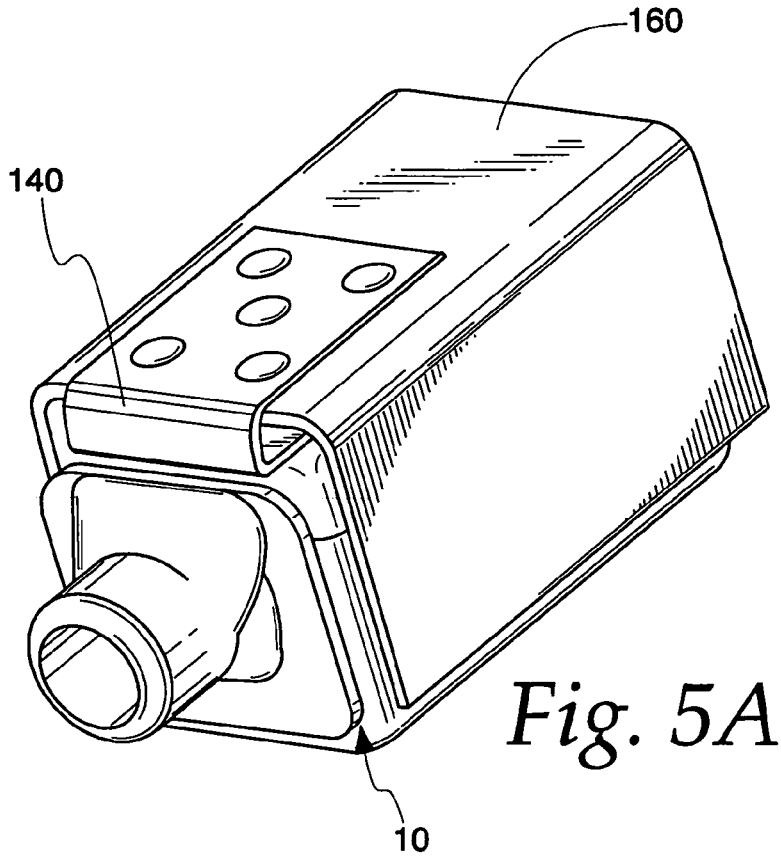
FIGS. 5A and 5B illustrate yet another variation of FIGS. 3A and 3B.
Figure 5B:
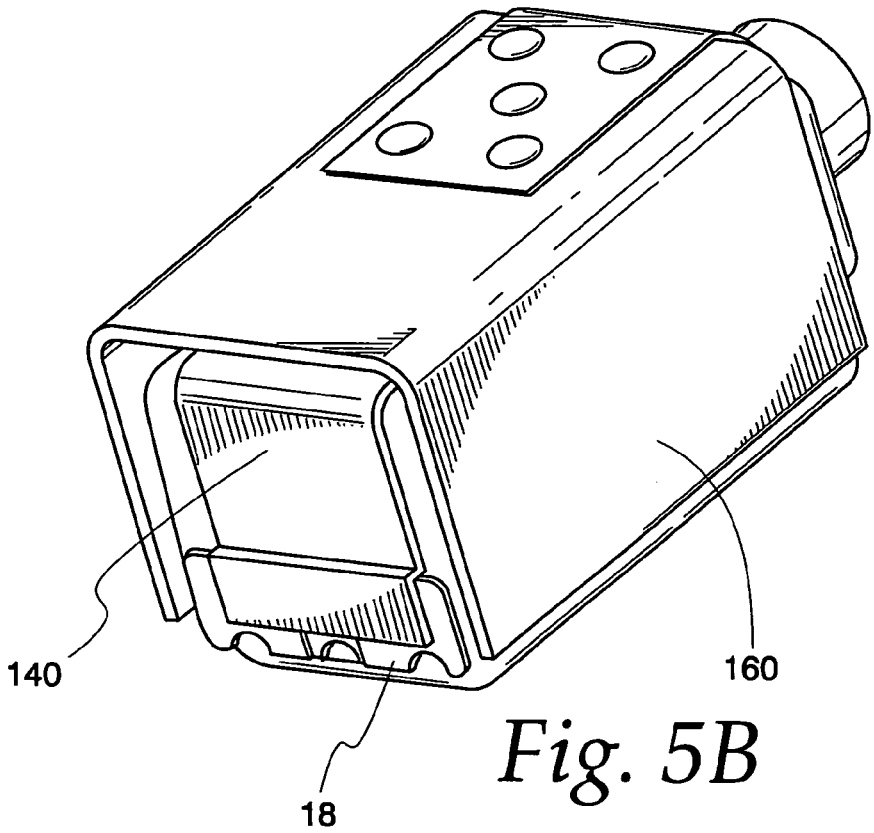

FIGS. 5A and 5B illustrate a variation of the embodiment of FIGS. 3A and 3B. In FIGS. 5A and 5B, a jacket 160 includes three sides giving it a U-shaped cross-section. Accordingly, the jacket 160 lacks a rear section that fits over the flex-PCB 140 adjacent to the electrical connector assembly 18 of the receiver 10. Thus, the jacket 160 provides more access to this region of the receiver 10.

Figure 6A:
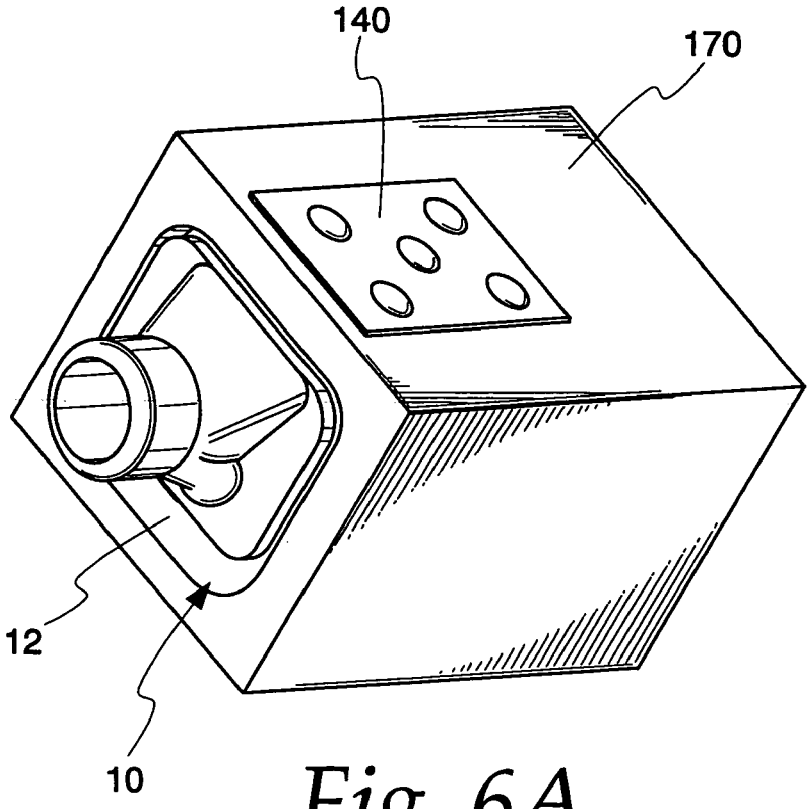
FIGS. 6A and 6B illustrate another embodiment of the present invention where the jacket is made of epoxy.
Figure 6B:
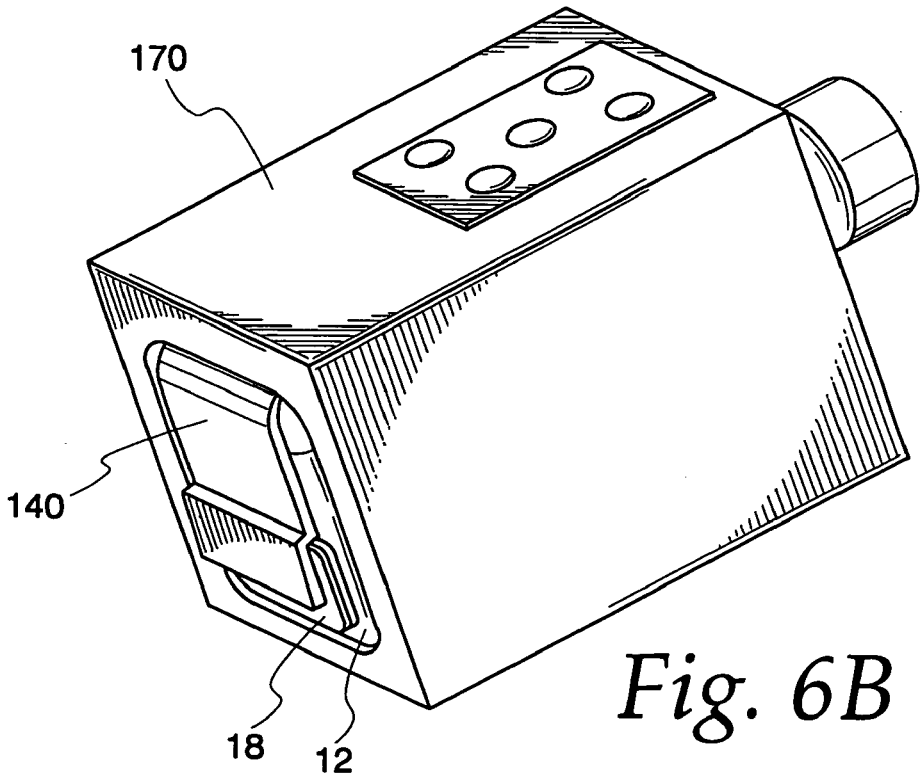

FIGS. 6A and 6B depart from the previous embodiments where the jackets were preformed structures attached to the housing 12 of the receiver 10. Here, an epoxy jacket 170 is placed over the receiver 10 and the extended flex-PCB 140, which is coupled to the electrical connector assembly 18 of the receiver 10. The epoxy jacket 170 could be used on a configuration similar to that of FIGS. 1A and 1B where there is no flex-PCB 140.

The epoxy jacket 170 is shown having a uniform thickness. However, the epoxy layer comprising the jacket could be strategically placed in regions where the side walls of the housing 12 of the receiver 10 are known to vibrate more in operation. For example, the middle point of a side surface of the housing 12 will typically vibrate more and, thus, a thicker layer of epoxy could be applied there. In such a case, the final assembly may resemble more of an ellipsoid.

The epoxy layer can be of varying thicknesses, but is usually between 0.25 mm and 1.0 mm. It can also be molded to a certain shape, such as a conical shape, to fit within the hearing aid or telecommunications system.

The epoxy can be one of many types. For example, it can be 3AB of the 3M Corporation of Minneapolis, Minn. It could also be configured to include metallic particles to provide electromagnetic shielding. Further, a first layer of epoxy could be placed on the housing 12. Then, a foil of soft magnetic material could be placed around the first layer. Finally, a second layer could be placed over the top of the foil. The foil would provide electromagnetic shielding; the epoxy would provide enhanced structural integrity.

Figure 7A:
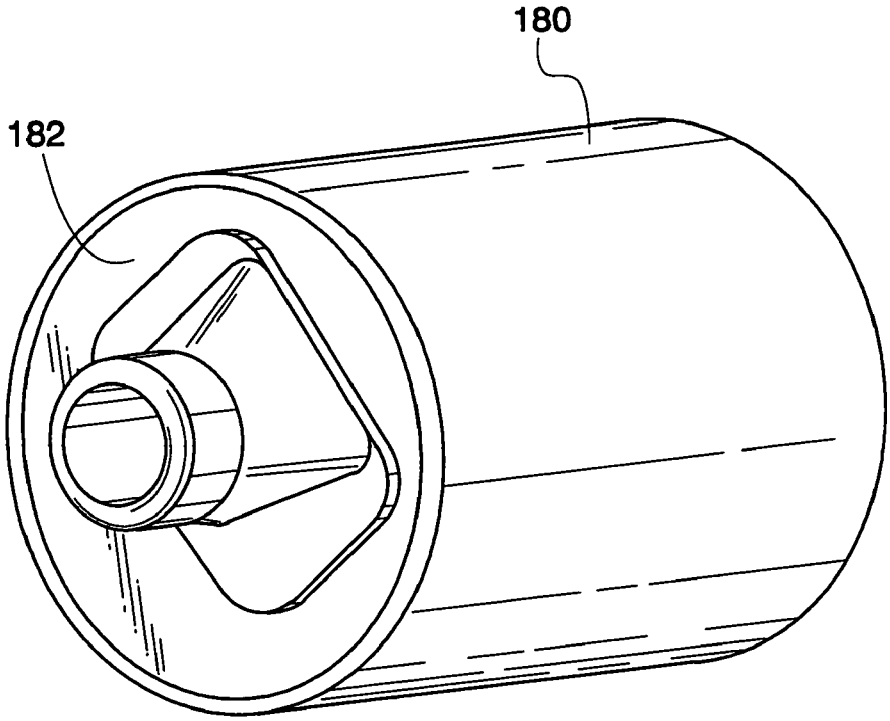
FIGS. 7A and 7B illustrate yet a further embodiment of the present invention where an acoustic dampening material is located between the receiver than the jacket.
Figure 7B:
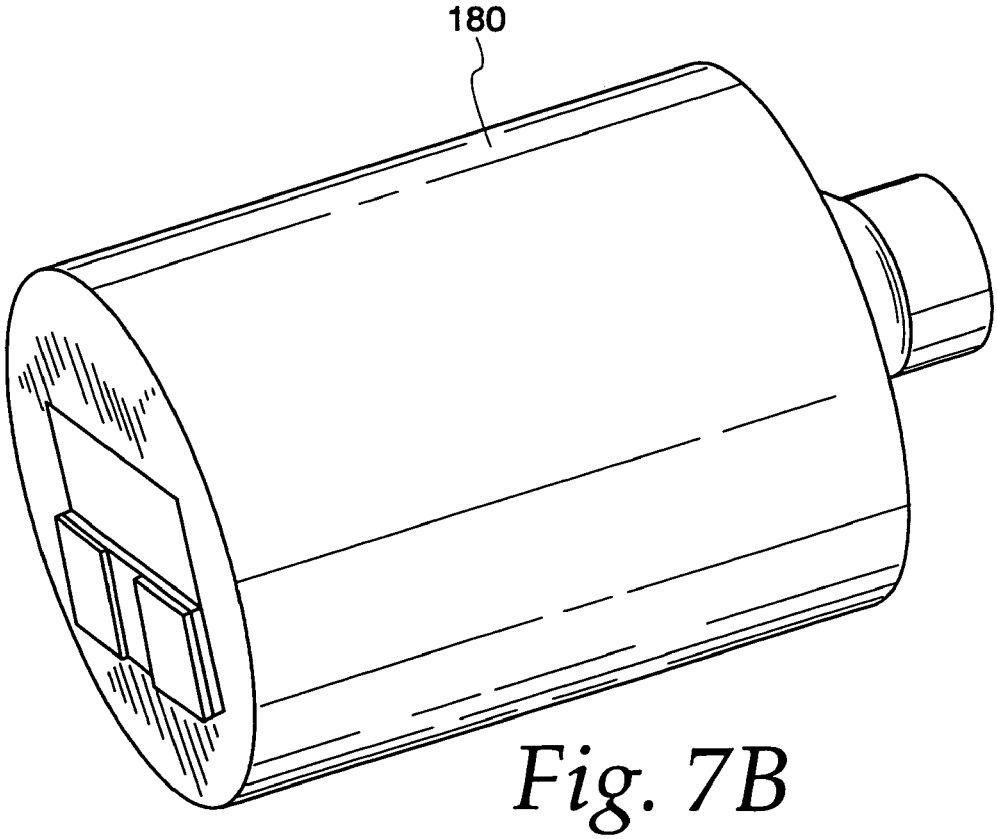
Figure 8A:
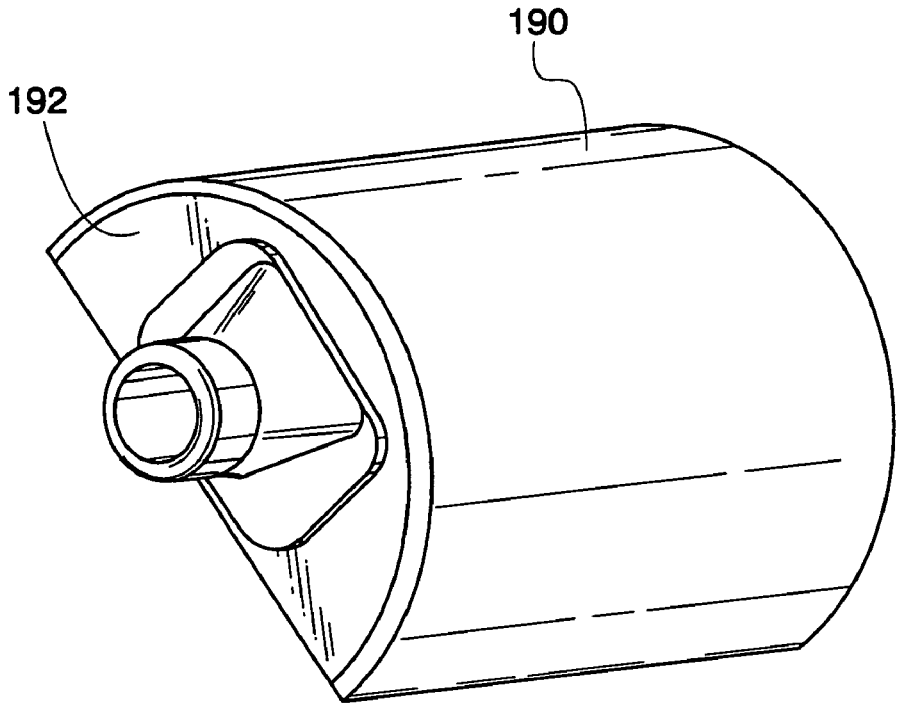
FIGS. 8A and 8B illustrate a D-shaped receiver and jacket arrangement according one embodiment of the present invention.
Figure 8B:
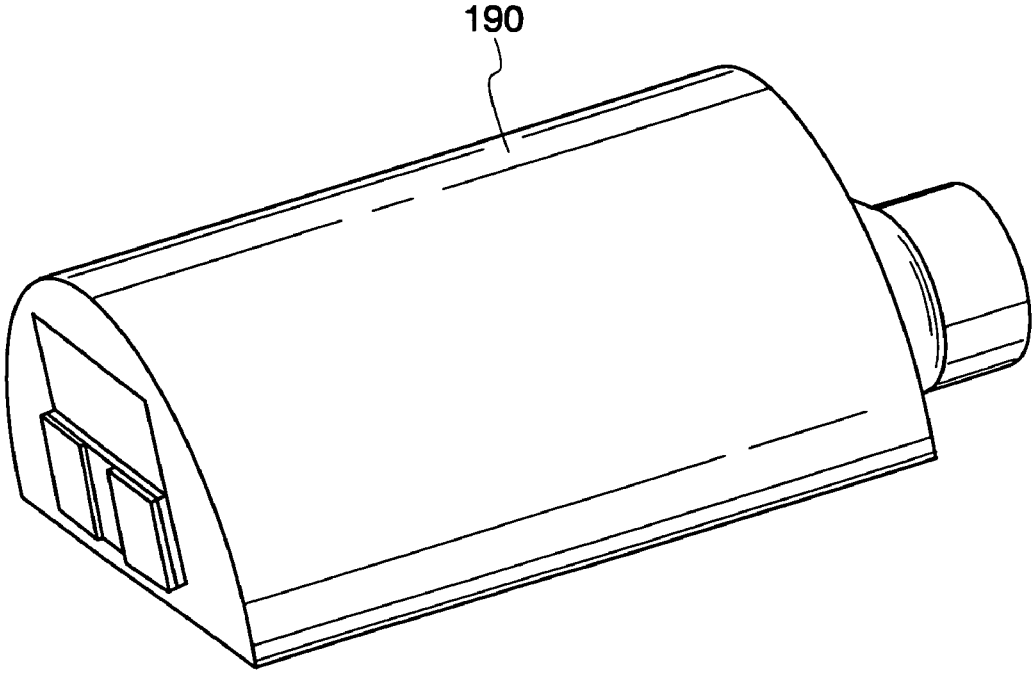

FIGS. 7A and 7B illustrate a further embodiment where a cylindrical jacket 180 has an acoustical dampening component 182 located thereunder. FIGS. 8A and 8B illustrate another embodiment where a D-shaped jacket 190 has an acoustical dampening component 192 located thereunder. The D-shaped jacket 190 has a D-shaped cross section. The cylindrical jacket 180 or D-shaped jacket 190 can be a soft magnetic material, stainless steel, or a polymer. The dampening components 182, 192 can be silicone or a resilient material such as C-Flex or Seal-Guard. The resilient material may be molded into a variety of shapes (even a custom-shaped mold) so that the receiver 10 fits nicely within a confined region of the hearing aid or telecommunication system. In the embodiment of FIGS. 7A and 7B and FIGS. 8A and 8B, the cylindrical jacket 180 and the D-shaped jacket 190, respectively, provides structural integrity and also possible electromagnetic shielding. The dampening components 182, 192 provide acoustical and vibrational shielding. While these are the only embodiments where an additional dampening component is used, it can also be provided in a thin layer below the previous jackets. Usually, at least about 0.5 mm of the dampening component is needed to provide the desired results.

The aforementioned jackets may also include a male or female mating structure that mates with a corresponding structure in the final assembly. When this is the case, the receiver can be slid into a mating fit within the assembly and rely on pressure for making electrical contact at the electrical connector assembly. Thus, in this embodiment, the jacket may enhance the structural integrity, provide electromagnetic shielding, provide acoustical and vibrational shielding, and be used for mating with the final assembly.

In another embodiment, the D-shaped assembly shown in FIGS. 8A and 8B is easily transformed into a trapezoidal-shaped assembly by planing the top portion of the D-shaped jacket 190. The resulting assembly has a substantially trapezoidal-shaped cross section. It will be understood that the receiver 10 can be shaped into any geometry to fit within the D-shaped assembly.

In any of the foregoing embodiments shown or described, a microphone may be used in place of the receiver 10. When configured as a microphone, the output port 16 is a sound inlet port for receiving an acoustical signal, and the internal working components include commonly-known components for converting the acoustical signal to an audio signal. Examples of these components are disclosed in commonly assigned U.S. Pat. No. 6,169,810, titled "Electroacoustic Transducer," which is incorporated herein by reference in its entirety. Like the jacket covering the receiver, the jacket covering the microphone may provide any combination of structural integrity, electromagnetic shielding, or vibration reduction, for example. In addition, the jacket covering the microphone may include any combination of a polymeric material such as Kapton, stainless steel, a soft magnetic material such as a nickel-iron alloy, or an epoxy layer which may include metallic particles, for example.

While the invention has been shown with respect to a six-sided receiver, it can also be used on receivers or microphones of varying shapes. For example, it could be used on a D-shaped receiver or microphone, a cylindrical receiver or microphone, a trapezoid-shaped receiver or microphone, or a generally oval-shaped receiver or microphone.

Any of the aforementioned jackets may be dimensioned to cover more than one receiver or microphone or combination of receivers and microphones. For example, in one embodiment, two or more receivers are stacked on top of one another, and a jacket is disposed over the receivers according to any of the foregoing embodiments. The receivers may be welded or adhered together. In another embodiment, two or more receivers are placed side-by-side, and a jacket is disposed over the receivers according to any of the foregoing embodiments. In still another embodiment, one or more receivers and one or more microphones are either stacked on top one another or placed side-by-side, and a jacket is disposed thereover. In these embodiments, the jacket operates to increase vibrational dampening and offers additional structural integrity to the multiple transducer arrangement.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A transducer, comprising:

means for converting between an input audio signal and an acoustic signal;

a case in which said converting means is received;

a cover disposed over said case and having a top surface;

a port, through which said acoustic signal passes, coupled to at least a first end portion of said case; and a jacket having at least three sections, a first of said sections being adjacent said top surface, and a second and a third of said sections extending around corresponding sides of said cover and along a majority of corresponding sides of said case.

2. The acoustic receiver of claim 1, wherein said jacket includes, on at least an inner surface portion thereof, a layer of acoustical dampening material.

3. The acoustic receiver of claim 2, wherein said acoustic dampening material includes silicone.

4. The acoustic receiver of claim 1, wherein said port is an output port for broadcasting said acoustic signal, said output port being coupled to a first end portion of said cover for holding said cover to said case.

5. The acoustic receiver of claim 1, further comprising a flexible printed circuit board disposed between said first section of said jacket and said top surface of said cover, the flexible printed circuit board including electronics for processing said input audio signal.

6. The acoustic receiver of claim 1, further comprising an electrical connector assembly coupled to a second end portion of said case opposite said port.

7. The acoustic receiver of claim 6, further comprising a flexible printed circuit board disposed between said first section of said jacket and said top surface of said cover, the printed circuit board being directly connected to said electrical connector assembly.

8. The acoustic receiver of claim 6, wherein said jacket includes at least four sections, a fourth of said sections extending along a second end portion of said cover adjacent said second end portion of said case.

9. The acoustic receiver of claim 8, wherein said fourth section is spot-welded to said second end portion of said cover.

10. The acoustic receiver of claim 8, wherein said fourth section also extends along at least part of said second end portion of said case.

11. The acoustic receiver of claim 1, wherein respective portions of said second and third sections of said jacket are secured to respective sides of said case for holding said cover to said case.

12. The acoustic receiver of claim 11, wherein said second and third sections are spot-welded at a plurality of spots to respective sides of said case.

13. The acoustic receiver of claim 11, wherein said second and third sections are permanently affixed to said respective sides of said case by an adhesive.

14. The acoustic receiver of claim 11, wherein said fourth section is permanently affixed to said second end portion of said cover.

15. The acoustic receiver of claim 1, wherein said jacket is an epoxy jacket having a first epoxy layer.

16. The acoustic receiver of claim 15, wherein said first epoxy layer includes metallic particles for shielding said converting means from the effects of electromagnetic interference.

17. The acoustic receiver of claim 15, wherein said epoxy jacket further includes a second epoxy layer and a foil of soft magnetic material sandwiched between said first and second epoxy layers.

18. The acoustic receiver of claim 15, wherein said epoxy layer has a thickness no greater than about 1 millimeter.

19. The acoustic receiver of claim 15, wherein said epoxy layer has a non-uniform thickness, said thickness being greater proximate the middle of said second and third sections.

20. A transducer, comprising:

means for converting between an input audio signal and an acoustic signal;

a case for surrounding said converting means;

a cover covering said case and having a top surface;

a port, through which said acoustic signal passes, coupled to a first end portion of said case and a first end portion of said cover for holding said cover to said case; and a jacket having at least three sections, a first of said sections being adjacent said top surface, and a second and a third of said sections extending around corresponding sides of said cover and along a majority of corresponding sides of said case, respective portions of said second and third sections of said jacket being affixed to respective sides of said case for holding said cover to said case.

21. A transducer, comprising:

means for converting between an input audio signal and an acoustic signal;

a case for receiving said converting means;

a cover positioned over said case and having a top surface;

a port through which said acoustic signal passes;

an electrical connector assembly coupled to an end portion of said case; and a jacket having at least four sections, a first of said sections being adjacent said top surface, and a second and a third of said sections extending around corresponding sides of said cover and along a majority of corresponding sides of said case, respective portions of said second and third sections of said jacket being affixed to respective sides of said case for holding said cover to said case, a fourth of said sections extending along an end portion of said cover adjacent said end portion of said case.

* * * * *

UNITED STATES PATENT AND TRADEMARK OFFICE

CERTIFICATE OF CORRECTION

PATENT NO. : 7,657,048 B2
APPLICATION NO. : 11/634586
DATED : February 2, 2010
INVENTOR(S) : van Halteren et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 693 days.

Signed and Sealed this

Thirtieth Day of November, 2010

David J. Kappos

David J. Kappos
*Director of the United States Patent and Trademark Office*